US009104125B2

(12) United States Patent
Sakamoto et al.

(10) Patent No.: US 9,104,125 B2
(45) Date of Patent: Aug. 11, 2015

(54) ELECTROSTATIC CHARGE IMAGE DEVELOPING TONER, ELECTROSTATIC CHARGE IMAGE DEVELOPING DEVELOPER, TONER CARTRIDGE, PROCESS CARTRIDGE, IMAGE FORMING APPARATUS, AND IMAGE FORMING METHOD

(75) Inventors: Shinya Sakamoto, Kanagawa (JP); Satoshi Inoue, Kanagawa (JP); Satoshi Yoshida, Kanagawa (JP); Eisuke Iwazaki, Kanagawa (JP); Tsuyoshi Murakami, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 69 days.

(21) Appl. No.: 13/282,960

(22) Filed: Oct. 27, 2011

(65) Prior Publication Data

US 2012/0270145 A1 Oct. 25, 2012

(30) Foreign Application Priority Data

Apr. 21, 2011 (JP) ..... 2011-094739

(51) Int. Cl.
*G03G 9/087* (2006.01)
*G03G 9/08* (2006.01)
*G03G 9/097* (2006.01)

(52) U.S. Cl.
CPC ..... *G03G 9/0804* (2013.01); *G03G 9/0821* (2013.01); *G03G 9/08755* (2013.01); *G03G 9/08795* (2013.01); *G03G 9/08797* (2013.01); *G03G 9/0975* (2013.01)

(58) Field of Classification Search
CPC ..... G03G 9/0804; G03G 9/08755; G03G 9/0821; G03G 13/08
USPC ..... 430/108.3, 109.4, 108.2, 137.14, 430/123.52, 123.55, 123.56, 123.5; 399/252
See application file for complete search history.

(56) References Cited

U.S. PATENT DOCUMENTS

| | | | | |
|---|---|---|---|---|
| 2006/0045571 | A1* | 3/2006 | Matsuura et al. | 399/149 |
| 2010/0098462 | A1 | 4/2010 | Yang et al. | |
| 2011/0300477 | A1* | 12/2011 | Yoshida et al. | 430/105 |

FOREIGN PATENT DOCUMENTS

| | | | | |
|---|---|---|---|---|
| JP | H06-214418 | A | | 8/1994 |
| JP | H07-146588 | A | | 6/1995 |
| JP | A-2001-066822 | | | 3/2001 |
| JP | A-2004-184748 | | | 7/2004 |
| JP | A-2004-279598 | | | 10/2004 |
| JP | A-2004-279809 | | | 10/2004 |
| JP | 2005-266012 | A | | 9/2005 |
| JP | 2008-015334 | A | * | 1/2008 |
| JP | A-2010-078828 | | | 4/2010 |
| JP | 2010-519590 | A | | 6/2010 |
| JP | A-2010-145508 | | | 7/2010 |
| JP | A-2010-204243 | | | 9/2010 |

OTHER PUBLICATIONS

Grant, R. et al., ed., Grant & Hackh's Chemical Dictionary, fifth edition, McGraw-Hill Book Company, NY (1987), p. 573.*
Japanese Patent Office AIPN machine-assisted English-language translation of JP 2008-015334 (pub. Jan. 2008).*
Jan. 6, 2015 Office Action issued in Japanese Application No. 2011-094739.

* cited by examiner

*Primary Examiner* — Janis L Dote
(74) *Attorney, Agent, or Firm* — Oliff PLC

(57) ABSTRACT

An electrostatic charge image developing toner includes a binder resin that contains an amorphous polyester resin and a colorant. The toner satisfies the following expressions: 20 μS/cm≤ρ≤150 μS/cm, and 0.01%<Cm/(Cc+Co)×100<0.1%, where ρ represents the conductivity of a supernatant solution when 0.1 g of the toner is dissolved in 30 ml of tetrahydrofuran, Cm represents the content (% by mass) of metal elements Al, Mg, and Fe, Cc represents the content (% by mass) of carbon, and Co represents the content (% by mass) of oxygen.

17 Claims, 2 Drawing Sheets

ELECTROSTATIC CHARGE IMAGE DEVELOPING TONER, ELECTROSTATIC CHARGE IMAGE DEVELOPING DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2011-094739 filed Apr. 21, 2011.

BACKGROUND

1. Technical Field

The present invention relates to an electrostatic charge image developing toner, an electrostatic charge image developing developer, a toner cartridge, a process cartridge, an image forming apparatus, and an image forming method.

2. Related Art

A method of visualizing image information via an electrostatic charge image, such as an electrophotographic method, has been used in various fields. In the electrophotographic method, an electrostatic latent image is formed on an image holding member (latent image forming process) through the use of charging and exposing processes, the electrostatic latent image is developed (developing process) by the use of an electrostatic charge image developing developer (hereinafter, also simply referred to as "developer") containing an electrostatic charge image developing toner (hereinafter, also simply referred to as "toner"), and the developed image is visualized through the use of a transfer process and a fixing process. The developers used herein are classified into two-component developers including a toner and a carrier and single-component developers including only a magnetic toner or a nonmagnetic toner.

Regarding these toners, the improvement in toner performance has been studied by defining amounts of components contained in a toner surface layer part or in the toner.

SUMMARY

According to an aspect of the invention, there is provided an electrostatic charge image developing toner including: a binder resin that contains an amorphous polyester resin; and a colorant, wherein the toner satisfies the following expressions, 20 μS/cm≤ρ≤150 μS/cm and 0.01%<Cm/(Cc+Co)×100<0.1%, where ρ represents the conductivity of a supernatant solution when 0.1 g of the toner is dissolved in 30 ml of tetrahydrofuran, Cm represents the content (% by mass) of metal elements Al, Mg, and Fe, Cc represents the content (% by mass) of carbon, and Co represents the content (% by mass) of oxygen.

BRIEF DESCRIPTION OF THE DRAWINGS

Exemplary embodiments of the present invention will be described in detail based on the following figures, wherein.

DETAILED DESCRIPTION

Figure 1:
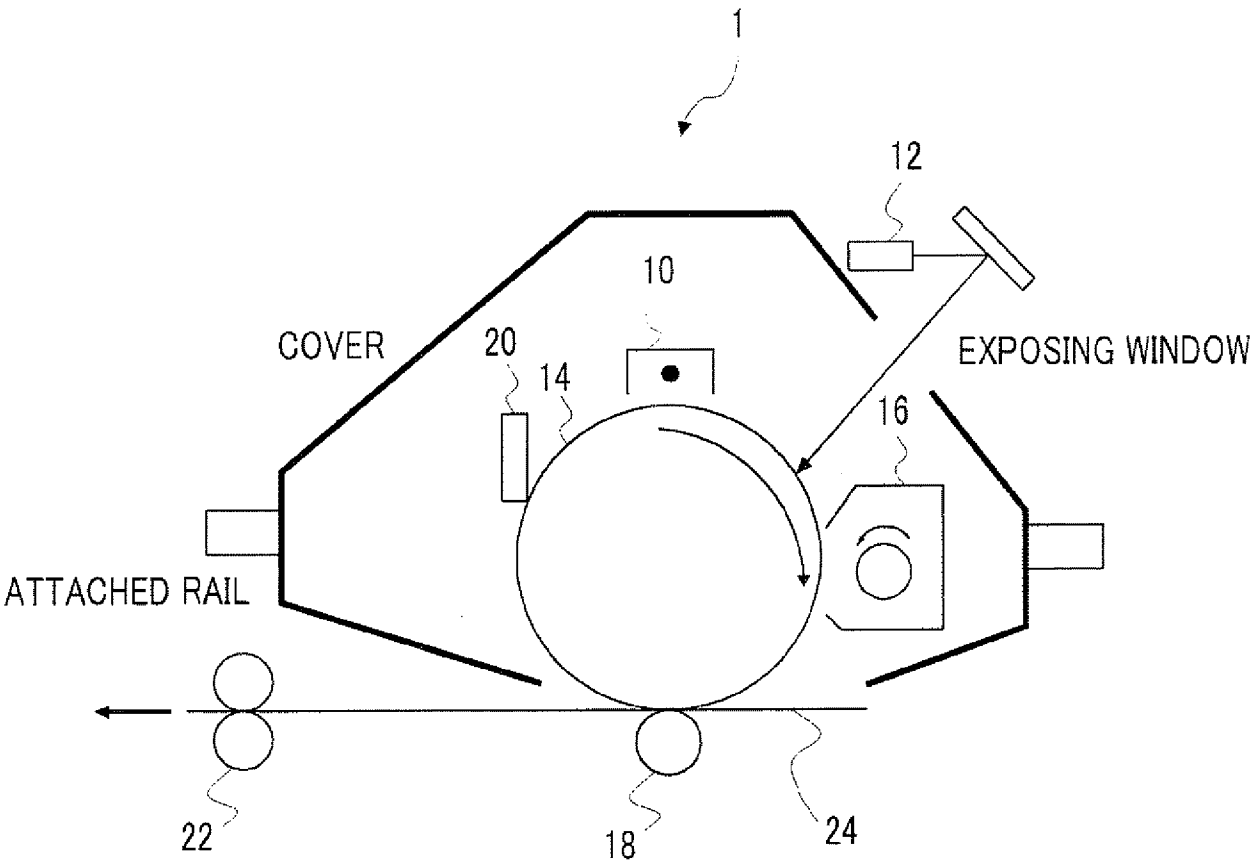
FIG. 1 is a diagram schematically illustrating the exemplary configuration of a process cartridge according to an exemplary embodiment of the invention.

Hereinafter, an exemplary embodiment of the invention will be described.

The exemplary embodiment is an example of the invention and the invention is not limited to the exemplary embodiment.

An electrostatic charge image developing toner according to the exemplary embodiment of the invention is prepared through the use of an aggregation process and a coalescence process in an aqueous medium and includes a binder resin including an amorphous polyester resin, and the conductivity of a solution obtained by dissolving the toner in tetrahydrofuran is in the range of from 20 μS/cm to 150 μS/cm (or from about 20 μS/cm to about 150 μS/cm).

When a toner including an amorphous polyester resin as a binder resin is used, the image intensity of a halftone image formed on a sheet of paper having a high water content under a high-humidity environment and having coarse fiber may be lowered.

As the result of intensive study of the inventor et al., it has been discovered that even when a toner including an amorphous polyester resin as a binder resin is used, it is possible to suppress the lowering of the image intensity of a halftone image formed on a sheet of paper having a high water content under a high-humidity environment and having coarse fibers by adjusting the conductivity of a tetrahydrofuran (THE) soluble to a predetermined value.

The THF soluble included in the toner is mainly the amorphous binder resin. Accordingly, the conductivity of the THF soluble is easily influenced by an amount of ionic materials present in the amorphous binder resin in the toner or in the vicinity of the binder resin. The ionic materials included in the toner are considered to originate from a catalyst used to produce a surfactant or a binder resin. The reason for improvement of the toner according to this exemplary embodiment is considered as follows. That is, in the toner including an amorphous polyester resin as a binder resin, the ionic materials may easily move due to the moisture contained in a sheet of paper when dissolving and fixing a halftone toner image formed on the sheet of paper having a high water content under a high-humidity environment and having coarse fiber by the use of the toner. When the amount of the ionic materials is in an appropriate range, the toner is maintained in a state where the distribution of the ionic materials in the dissolved toner is substantially constant. Accordingly, the phase separation of molecular chains constituting the binder resin is hardly caused and thus the lowering of the image intensity after the fixation is suppressed.

In this exemplary embodiment, the conductivity of the solution in which the toner is dissolved in tetrahydrofuran is controlled in the above-mentioned range by providing an aging process after the stop of the aggregation process and before the coalescence process in the production method including the aggregation process and the coalescence process in an aqueous medium. The aging process is performed by leaving the resultant while stirring the resultant, for example, at a room temperature 25° C.±5° C. for from about 17 hours to about 58 hours.

Here, when the aging time is excessively long, the amount of ionic materials in the toner increases and thus the conductivity tends to be raised. When the aging time is excessively short, the amount of ionic material in the toner decreases and thus the conductivity tends to be lowered.

The conductivity of the solution in which the electrostatic charge image developing toner according to this exemplary embodiment is dissolved in tetrahydrofuran is preferably in the range of from 20 μS/cm to 150 μS/cm and more preferably in the range of from 20 μS/cm to 100 μS/cm. When the conductivity is less than 20 μS/cm or greater than 150 μS/cm, the image intensity of a halftone image formed on a sheet of paper having a high water content under a high-humidity environment and having coarse fiber is lowered. The reason is considered to be that the image intensity after the fixation is lowered because the ionic materials in the dissolved toner is easily eccentrically located and the phase separation of molecular chains constituting the binder resin is caused. When the halftone image is formed on a sheet of paper having coarse fiber, the particle density is lowered. When the water content is distributed in the sheet of paper, the lowering of the image intensity becomes more marked.

The electrostatic charge image developing toner according to this exemplary embodiment is prepared through the aggregation process and the coalescence process in the aqueous medium and an aggregating agent containing at least one metal element selected from Al, Mg, and Fe is used in the aggregation process. When the content of the metal element originating from the aggregating agent of the toner is defined as Cm (% by mass), the content of carbon is defined as Cc (% by mass), and the content of oxygen is defined as Co (% by mass), the following conditional expression is preferably satisfied. When the following conditional expression is satisfied, the metal element hardly moves into the moisture in the sheet of paper from the toner system. Accordingly, the distribution of the ionic materials in the dissolved toner is maintained in a more homogeneous state and the image intensity of the halftone image formed on the sheet of paper is further improved.

$$0.01\% < Cm/(Cc+Co) \times 100 < 0.1\%$$

When Cm/(Cc+Co) is equal to or less than 0.01% or equal to or greater than, 0.1%, the image intensity of the halftone image formed on a sheet of paper having a high water content under a high-humidity environment and having coarse fiber may be lowered.

The following conditional expression is more preferably satisfied.

$$0.05\% < Cm/(Cc+Co) \times 100 < 0.07\%$$

The electrostatic charge image developing toner according to this exemplary embodiment preferably includes 3-hydroxy-2,2'-iminodisuccinic acid (HIDS). The 3-hydroxy-2,2'-iminodisuccinic acid forms a complex material along with the ionic materials or the metal element and has a high affinity for the polyester resin. The ionic materials or the metal element hardly moves into the moisture in the sheet of paper from the toner system and the distribution of the ionic materials in the dissolved toner is thus maintained more homogeneous, whereby the image intensity of the halftone image formed on the sheet of paper is further enhanced.

The electrostatic charge image developing toner according to this exemplary embodiment preferably includes a crystalline resin as the binder resin in the range of from 0.1% by mass to 50% by mass (or from about 0.1% by mass to about 50% by mass) based on the total mass of the binder resin and more preferably in the range of from 10% by mass to 25% by mass. The crystalline resin has a low hydrophilic property. Accordingly, when the content of the crystalline resin is in the above-mentioned range, the ionic materials hardly move into the moisture in the sheet of paper and the distribution of the ionic materials in the dissolved toner is thus maintained more homogeneous, whereby the image intensity of the halftone image formed on the sheet of paper is further enhanced. When the content of the crystalline resin is less than 0.1% by mass or greater than 50% by mass, the image intensity of a halftone image formed on a sheet of paper having a high water content under a high-humidity environment and having coarse fiber may be lowered.

In the electrostatic charge image developing toner according to this exemplary embodiment, the flow tester half-flow temperature is preferably in the range of from 120° C. to 150° C. (or from about 120° C. to about 150° C.) and more preferably in the range of from 130° C. to 140° C. When the flow tester half-flow temperature in the above-mentioned range, the viscosity when dissolving the toner is high and the mobility of the ionic materials is lowered. The ionic materials hardly move into the moisture in the sheet of paper and the distribution of the ionic materials in the dissolved toner is thus maintained more homogeneous, whereby the image intensity of the halftone image formed on the sheet of paper is further enhanced. When the flow tester half-flow temperature of the toner is less than 120° C. or greater than 150° C., the image intensity of a halftone image formed on a sheet of paper having a high water content under a high-humidity environment and having coarse fiber may be lowered.

Constituent Components of Toner

Toner particles in the electrostatic charge image developing toner according to this exemplary embodiment include a binder resin including an amorphous polyester resin and a colorant. The toner particles include other components such as a release agent as needed. In the toner according to this exemplary embodiment, a crystalline resin in addition to the amorphous polyester resin may be included as the binder resin.

In this exemplary embodiment, the "crystalline property" of the "crystalline resin" means that the crystalline resin exhibits a clear endothermic peak, not a step-like endothermic variation, in differential scanning calorimetry (DSC) of the resin or the toner. Specifically, in the differential scanning calorimetry (DSC) using a differential scanning calorimeter (DSC-60 type) made by Shimadzu Corporation having an automatic tangential processing system, when the temperature from an onset point to the peak top of the endothermic peak at the time of raising the temperature at a temperature rising speed of 10° C./min is not higher than 10° C., it is defined as a "clear" endothermic peak.

From the viewpoint of a sharp melt property, the temperature from the onset point to the peak top of the endothermic peak is preferably is not higher than 10° C. and more preferably not higher than 6° C. A point in a flat part of a baseline in a DSC curve and a point in a flat part of a falling part from the baseline are designated and the intersection of tangential lines of the flat parts between both points is automatically calculated as the "onset point" by the automatic tangential processing system. The endothermic peak may exhibits a peak with a width of from 40° C. to 50° C. for the toner.

The "amorphous resin" used as the binder resin means a resin in which the temperature form the onset point to the peak top of the endothermic peak is greater than 10° C. in the differential scanning calorimetry (DSC) of a resin or toner or a resin of which the clear endothermic peak is not recognized. Specifically, in the differential scanning calorimetry (DSC) using the differential scanning calorimeter (DSC-60 type) made by Shimadzu Corporation having the automatic tangential processing system, when the temperature from the onset point to the peak top of the endothermic peak at the time of raising the temperature at a temperature rising speed of 10° C./min is greater than 10° C. or when any clear endothermic peak is not recognized, it is defined to be "amorphous". The temperature from the onset point to the peak top of the endothermic peak is preferably greater than 12° C. and it is more preferable that any clear endothermic peak is not recognized.

The method of calculating the "onset point" in the DSC curve is the same as in the "crystalline resin".

The amorphous polyester resin is obtained by polymerizing an acid component (polyvalent carboxylic acid) and an alcohol component (polyol). The "acid-originating component" in this exemplary embodiment indicates a constituent site which is an acid component before the polymerization of the polyester resin and the "alcohol-originating component" indicates a constituent site which is an alcohol component before the polymerization of the polyester resin.

Acid-Originating Component

The acid-originating component is not particularly limited but an aliphatic dicarboxylic acid or an aromatic carboxylic acid is preferably used.

Examples of the aliphatic dicarboxylic acid include oxalic acid, malonic acid, succinic acid, glutaric acid, adipic acid, pimelic acid, suberic acid, azelaic acid, sebacic acid, 1,9-nonane dicarboxylic acid, 1,10-decane dicarboxylic acid, 1,11-undecane dicarboxylic acid, 1,12-dodecane dicarboxylic acid, 1,13-tridecane dicarboxylic acid, 1,14-tetradecane dicarboxylic acid, 1,16-hexadecane dicarboxylic acid, 1,18-octadecane dicarboxylic acid, lower alkylesters thereof, and acid anhydrides thereof, but the acid-originating component is not limited to these examples. Examples of the aromatic carboxylic acid include lower alkylesters or acid anhydrides of aromatic carboxylic acids such as terephthalic acid, isophthalic acid, phthalic anhydride, trimellitic anhydride, pyromellitic acid, and naphthalene dicarboxylic acid. Other examples thereof include alicyclic carboxylic acids such as cyclohexane dicarboxylic acid. To guarantee more excellent fixability, trivalent or higher carboxylic acid (trimellitic acid or acid anhydride thereof) is preferably used together with dicarboxylic acid so as to take a bridged structure or a branched structure. Specific examples of alkenyl succinic acids include dodecenyl succinic acid, dodecyl succinic acid, stearyl succinic acid, octyl succinic acid, and octadecenyl succinic acid.

Alcohol-Originating Component

The alcohol-originating component is not particularly limited, but aliphatic diols may be preferably used. Examples thereof include ethylene glycol, 1,3-propane diol, 1,4-butane diol, 1,5-pentane diol, 1,6-hexane diol, 1,7-heptane diol, 1,8-octane diol, 1,9-nonane diol, 1,10-decane diol, 1,11-undecane diol, 1,12-dodecane diol, 1,13-tridecane diol, 1,14-tetradecane diol, 1,18-octadecane diol, and 1,20-eicosane diol. Diethylene glycol, triethylene glycol, neopentyl glycol, glycerin, alicyclic diols such as cyclohexane diol, cyclohexane dimethanol, and hydrogen-added bisphenol A, and aromatic diols such as ethylene oxide adducts of bisphenol A and propylene oxide adducts of bisphenol A. To guarantee excellent fixability, trivalent or higher alcohol (glycerin, trimethylolpropane, pentaerythritol) may be used together with diols so as to take a cross-linked structure or a branched structure.

The method of producing the amorphous polyester resin is not particularly limited and a general polyester polymerization method of causing an acid component to react with an alcohol component. Examples thereof include a direct polycondensation method and an ester exchange method and these methods may be used differently depending on the kinds of monomers. The mole ratio (acid component/alcohol component) when causing the acid component and the alcohol component to react with each other varies depending on the reaction conditions, but is generally about 1/1 although it is not necessarily appropriate.

The production of the amorphous polyester resin may be carried out, for example, at a polymerization temperature of from 180° C. to 230° C. and the reaction may be allowed while reducing the pressure of the inside of a reaction system as needed to remove water or alcohol generated at the time of polycondensation. When the monomers are not dissolved or phase-soluble at a reaction temperature, the polymerization reaction may proceed partially fast or slowly and thus many non-colored particles may be generated. Accordingly, a high-melting-point solvent may be added as a solubilizing agent and may dissolve the particles. The polycondensation reaction may be performed while distilling the solubilizing agent. When a monomer having poor solubility in the copolymerization reaction is present, the monomer having poor solubility and an acid or alcohol to be polycondensed may be condensed in advance and then the resultant may be polycondensed with the main component.

Examples of a catalyst which may be used to produce the amorphous polyester resin include alkali metal compounds such as sodium and lithium; alkali earth metal compounds such as magnesium and calcium; metal compounds such as zinc, manganese, antimony, titanium, tin, zirconium, and germanium; phosphite compounds, phosphate compounds, and amine compounds. Among these, a tin-containing catalyst such as tin, tin formate, tin oxalate, tetraphenyltin, dibutyltin dichloride, dibutyltin oxide, and diphenyltin oxide may be preferably used.

In this exemplary embodiment, as long as it may be copolymerized as a resin for the electrostatic charge image developing toner, a compound having a hydrophilic polar group may be used. When polyester is used as the resin, specific examples thereof include dicarboxylic compounds in which an aromatic ring is directly replaced with a sulfonyl group, such as sodium sulfonyl terephthalate and 3-sodium sulfonyl isophthalate.

The weight-average molecular weight Mw of the amorphous polyester resin is preferably equal to or more than 6,000 and more preferably in the range of from 10,000 to 300,000. When the weight-average molecular weight Mw of the amorphous polyester resin is less than 6,000, the toner may deeply permeate the surface of a recording medium such as a sheet of paper to cause fixing irregularity at the time of fixing, or the resistance to the folding of the fixed image may be lowered. When the weight-average molecular weight Mw of the amorphous polyester resin is greater than 300,000, the viscosity at the time of melting may be excessively raised and the temperature for reaching the viscosity suitable for the fixation may be raised, whereby the fixability may be damaged.

The glass transition temperature (Tg) of the amorphous polyester resin is not particularly limited, but is preferably in the range of from 40° C. to 80° C. and more preferably in the range of from 50° C. to 60° C. When the glass transition temperature of the amorphous polyester resin is lower than 40° C., the storage property of the toner may be deteriorated. When the glass transition temperature of the amorphous polyester resin is higher than 80° C., the fixing temperature may be raised.

The composition of the crystalline resin is not particularly limited, as long as it has a crystalline property as defined above. Specific examples thereof include a crystalline polyester resin and a crystalline vinyl resin, and the crystalline polyester resin is preferable in view of adjustment of the adhesion to a sheet of paper at the time of fixation, the chargeability, and the adjustment of the melting temperature in the preferable range. An aliphatic crystalline polyester resin having an appropriate melting temperature is more preferable.

Examples of the crystalline vinyl resin include long-chain alkyls such as amyl(meth)acrylate, hexyl(meth)acrylate, heptyl(meth)acrylate, octyl(meth)acrylate, nonyl(meth)acrylate, decyl(meth)acrylate, undecyl(meth)acrylate, tridecyl(meth)acrylate, myristyl(meth)acrylate, cetyl(meth)acrylate, stearyl(meth)acrylate, oleyl(meth)acrylate, and behenyl(meth)acrylate and vinyl resins using ester(meth)acrylate of alkenyl. In this specification, the description "(meth)acryl" means to include both "acryl" and "methacryl".

On the other hand, the crystalline polyester resin is synthesized from an acid (dicarboxylic acid) component and an alcohol (diol) component, similarly to the amorphous polyester resin. In case of polymer in which another component is copolymerized with the main chain of the crystalline polyester, when the content of another component is 50 wt % or less, the copolymer is also called crystalline polyester resin.

The weight-average molecular weight Mw of the crystalline polyester resin is preferably equal to or greater than 8,000 and more preferably in the range of from 10,000 to 50,000. When the weight-average molecular weight Mw of the crystalline polyester resin is less than 8,000, the resistance to the folding of the fixed image may be lowered. When the weight-average molecular weight Mw of the crystalline polyester resin is greater than 50,000, the fixing temperature may be raised.

The melting temperature (Tm) of the crystalline polyester resin is not particularly limited, but is preferably in the range of from 40° C. to 80° C. and more preferably in the range of from 50° C. to 60° C. When the melting temperature of the crystalline polyester resin is lower than 40° C., the storage property of the toner may be deteriorated. When the melting temperature of the crystalline polyester resin is higher than 80° C., the fixing temperature may be raised.

The toner according to this exemplary embodiment may include a resin other than the polyester resin and the resin other than the polyester resin is not particularly limited. Specific examples thereof include styrenes such as styrene, p-chlorostyrene, and α-methyl styrene; acryl monomers such as methyl acrylate, ethyl acrylate, n-propyl acrylate, butyl acrylate, lauryl acrylate, and 2-ethylhexyl acrylate; methacryl monomers such as methyl methacrylate, ethyl methacrylate, n-propyl methacrylate, lauryl methacrylate, and 2-ethylhexyl methacrylate; ethylene-based unsaturated acid monomers such as acrylate, methacrylate, and sodium styrene sulfonate; vinyl nitriles such as acrylonitrile and methacrylonitrile; vinyl ethers such as vinyl methyl ether and vinyl isobutyl ether; vinyl ketones such as vinyl methyl ketone, vinyl ethyl ketone, and vinyl isopropenyl ketone; homopolymers of olefin monomers such as ethylene, propylene, and butadiene, copolymers of two or more monomers thereof, or mixtures thereof; nonvinyl condensed resins such as an epoxy resin, a polyester resin, a polyurethane resin, a polyamide resin, a cellulose resin, and a polyether resin or mixtures thereof with the above-mentioned vinyl resins; and graft polymers obtained by polymerizing vinyl monomers in the co-existence. These resins may be used singly or in combination of two or more kinds. Among these resins, the styrene resins or the acryl resins may be preferably used.

The toner according to this exemplary embodiment may include a release agent. Specific examples of the release agent include low-molecular polyolefins such as polyethylene, polypropylene, and polybutene, silicones having a softening point by heating, fatty acid amides such as oleic amide, erucamide, recinoleic amide, and stearic amide, plant waxes such as carnauba wax, rice wax, candelilla wax, Japanese wax, and jojoba oil, animal waxes such as bees wax, minerals such as montan wax, ozokerite, ceresin, paraffin wax, microcrystalline wax, and Fischer-Tropsch wax, petroleum waxes, and modifications thereof.

The release agent may be used singly or in combination of two or more kinds. The content of the release agent is preferably in the range of from 1 part by mass to 10 parts by mass based on 100 parts by mass of the binder resin and is more preferably in the range of from 5 parts by mass to 9 parts by mass.

Other components are not particularly limited and may be appropriately selected depending on the purpose. Examples thereof include various known additives such as inorganic particles and a charging control agent.

Inorganic particles may be added to the toner according to this exemplary embodiment as needed. Examples of the inorganic particles include known inorganic particles such as silica particles, titanium oxide particles, alumina particles, cerium oxide particles, or the particles of which the surface has been subjected to a hydrophobic process, and these particles may be used singly or in combination of two or more kinds. The silica particles having a refractive index smaller than that of the binder resin may be preferably used from the viewpoint of the coloring property or the transparency of overhead projector (OHP) permeability. The silica particles may be treated to various surface treatments and it is preferable that the surface is treated, for example, by the use of a silane coupling agent, a titanium coupling agent, or a silicon oil.

The viscoelasticity of the toner may be adjusted or the image glossiness or permeation in paper may be adjusted, by adding the inorganic particles. The content of the inorganic particles is preferably in the range of from 0.5% by mass to 20% by mass based on 100 parts by mass of the toner source material and more preferably in the range of from 1% by mass to 15% by mass.

A charging control agent may be added to the toner according to this exemplary embodiment as needed. Examples of the charging control agent include chromium-based azo dyes, iron-based azo dyes, aluminum-based azo dyes, and salicylic metal complexes.

Method of Producing Electrostatic Charge Image Developing Toner

The toner according to this exemplary embodiment is produced by the use of a wet production method such as an emulsification aggregation method (aggregation and coalescence method) including an aggregation process and a coalescence process in an aqueous medium.

The method of producing the electrostatic charge image developing toner according to this exemplary embodiment includes an aggregation process of mixing a resin dispersion including a resin, a colorant dispersion in which a colorant is dispersed, and a release agent dispersion in which a release agent is dispersed to form aggregated particles, a stop process of stopping the aggregation growth of the aggregated particles by adjusting pH in an aggregation system, an aging process of leaving the aggregated particles while stirring the aggregated particles at the temperature near the room temperature for a predetermined time, and a coalescence process of heating and coalescing the aggregated particles up to the glass transition temperature of the resin or higher to obtain toner particles. The method may further include a washing process of washing the toner particles obtained by the coalescence by the use of water and a drying process of drying the toner particles. The method may further include a shell layer forming process of adding the same resin or a different resin to attach the resin to the surface of the aggregated particles after the aggregation process.

The respective processes of the method of producing the electrostatic charge image developing toner will be described in detail. The method of producing the toner according to the exemplary embodiment is not limited to these processes.

Dispersion Preparing Process

In a dispersion preparing process, the resin dispersion, the colorant dispersion, the release agent dispersion, and the like are prepared.

The resin dispersion may be prepared by the use of the known phase-transfer emulsification method or a method of heating the resin up to the glass transition temperature of the resin or higher to emulsify the resin by the use of a mechanical shearing force. At this time, an ionic surfactant may be added thereto.

The colorant dispersion may be prepared, for example, by dispersing colorant particles of desired colors such as yellow, cyan, magenta, and black in a solvent by the use of an ionic surfactant.

The release agent dispersion may be prepared, for example, by dispersing a release agent in water along with a high-molecular electrolyte (such as an ionic surfactant, a high-molecular acid, and a high-molecular base), heating the dispersion solution up to the melting temperature of the release agent or higher, and making the resultant be particles by the use of a homogenizer or a pressure-discharging disperser which may apply a strong shearing force.

Aggregation Process

In the aggregation process, the resin dispersion and the colorant dispersion are mixed with the release agent dispersion as needed and the resin and the colorant are heterogeneously aggregated with the release agent as needed, whereby aggregated particles (core aggregated particles) having a diameter almost close to the desired toner particle diameter are formed.

Shell Layer Forming Process

In the shell layer forming process, aggregated particles (core/shell aggregated particles) having a core/shell structure in which a shell layer is formed on the surface of the core aggregated particles by attaching the resin to the surface of the core aggregated particles by the use of the resin dispersion including the resin to form a coating layer (shell layer) with a desired thickness.

The aggregation process and the shell layer forming process may be gradually repeated several times.

Here, the volume-average particle diameters of the resin particles, the colorant, and the release agent particles used in the aggregation process and the shell layer forming process are preferably equal to or less than 1 μm and more preferably in the range of from 100 nm to 300 nm, so as to facilitate the adjustment of the toner diameter and the size distribution to desired values.

The volume-average particle diameter may be measured by the use of a laser-diffraction particle size distribution meter (LA-700 made by Horiba Ltd.). In a measurement method, a sample in a dispersion liquid state is adjusted to be about 2 g in solid content and ion-exchanged water is added thereto to prepare about 40 mL. The resultant is introduced into a cell so as to reach an appropriate concentration and is left for about two minutes, and the measurement is then performed when the concentration in the cell becomes almost stable. The volume-average particle diameters of the channels are accumulated from the smallest volume-diameter particle diameter and the value when 50% is accumulated is defined as the volume-average diameter.

Stop Process

In the stop process, the aggregation growth of the aggregated particles is stopped by adjusting the pH in the aggregation system. For example, by adjusting the pH in the aggregation system to the range of from 6 to 9, the growth of the aggregated particles is stopped.

Aging Process

In the aging process, the aggregated particles are left in the liquid while stirring the aggregated particles, for example, at the room temperature 25° C.±5° C. for from 17 hours to 58 hours.

Coalescence Process

In the coalescence process, the solution including the aggregated particles obtained through the aggregation process, the shell layer forming process performed as needed, and the aging process is heated up to the melting temperature of the resin included in the aggregated particles or the glass transition temperature or higher to coalesce the aggregated particles, whereby toner particles are obtained.

Washing Process

In the washing process, at least a substitution washing using ion-exchanged water is performed on the dispersion of the toner particles obtained through the coalescence process, whereby the solid-liquid separation is performed. The solid-liquid separation method is not particularly limited, but the suction filtration, the pressure filtration, and the like are preferably used in view of productivity and the like.

Drying Process

In the drying process, the wet cake having been subjected to the solid-liquid separation is dried, whereby the toner particles are obtained. The drying method is not particularly limited, but freeze drying, flush jet drying, fluidized drying, and oscillatory fluidized drying, and the like are preferably used in view of productivity and the like.

Properties of Electrostatic Charge Image Developing Toner

The volume-average particle diameter of the electrostatic charge image developing toner according to this exemplary embodiment is preferably in the range of from 4 μm to 8 μm and more preferably in the range of from 5 μm to 7 μm. The number-average particle diameter is preferably in the range of from 3 μm to 7 μm and more preferably in the range of from 4 μm to 6 μm.

The measurement of the volume-average particle diameter and the number-average particle diameter is performed by measuring the particle diameter with an aperture diameter of 100 μm using Coulter Multisizer Type II (made by Beckman Coulter Inc.). At this time, the measurement is performed after the toner is dispersed in an electrolyte aqueous solution (isotone aqueous solution) by the use of ultrasonic waves for 30 seconds.

The volume-average size distribution index GSDv of the electrostatic charge image developing toner according to this exemplary embodiment is equal to or less than 1.27 and preferably equal to or less than 1.25. When the value of GSDv is greater than 1.27, the size distribution is not sharp and the resolution is lowered, thereby causing image defects such as toner scattering or fogging.

The volume-average particle diameter D50v and the volume-average size distribution index GSDv are obtained as follows. The accumulation distributions of the volume and the number are drawn from the smallest diameter in the size ranges (channels) into which the size distribution is divided on the basis of the toner size distribution measured by the Coulter Multisizer Type II (made by Beckman Coulter Inc.), the particle diameter at the 16% accumulation is defined as volume D16v and number D16p, the particle diameter at the 50% accumulation is defined as volume D50v and number D50p, and the particle diameter at the 84% accumulation is defined as volume D84v and number D84p. At this time, D50v represents the volume-average particle diameter and the volume-average size distribution index (GSDv) is calculated as $(D84v/D16v)^{1/2}$. $(D84v/D16v)^{1/2}$ represents the number-average size diameter distribution index (GSDp).

In the electrostatic charge image developing toner according to this exemplary embodiment, the shape factor SF1 expressed by the following expression is preferably in the range of from 110 to 140 and more preferably in the range of from 115 to 130.

$SF1=(ML^2/A)\times(\pi/4)\times100$ (where ML represents the maximum length (μm) of the toner particles and A represents the projection area ($\mu m^2$) of the toner particles)

When the shape factor SF1 of the toner particles is smaller than 110 or greater than 140, superior chargeability, cleaning ability, and transferability may not be obtained for a long period of time.

The shape factor SF1 is measured as follows by the use of the LUZEX image analyzer (FT made by Nireco Corp.). First, an optical microscopic image of toner particles scattered on a glass slide is input to the LUZEX image analyzer through the use of a video camera, the maximum length (ML) and the projection area (A) of 50 toner particles are measured, the value of $=(ML/A)\times(\pi/4)\times100$ for each toner particle is calculated, and the average value thereof is calculated as the shape factor SF1.

Electrostatic Charge Image Developing Developer

In this exemplary embodiment, the electrostatic charge image developing developer is not particularly limited as long as it includes the electrostatic charge image developing toner according to this exemplary embodiment, and may have an appropriate composition depending on its purpose. The electrostatic charge image developing developer according to this exemplary embodiment may be a single-component electrostatic charge image developing developer including the electrostatic charge image developing toner alone or a two-component electrostatic charge image developing developer using a combination of the electrostatic charge image developing toner and a carrier.

For example, when the carrier is used, the carrier is not particularly limited and known carriers may be used. Examples thereof include known carriers such as a resin-coated carrier described in JP-A-62-39879 and JP-A-56-11461.

Specific examples of the carrier include the following resin-coated carriers. Examples of the core particle of the carrier include iron, ferrite, and magnetite particles and the volume-average particle diameter thereof is in the range of from 30 μm to 200 μm.

Examples of the coating resin of the resin-coated carrier include homopolymers or copolymers including two or more kinds of monomers of styrenes such as styrene, p-chlorostyrene, and α-methyl styrene; α-methylene fatty acid monocarboxylic acids such as methyl acrylate, ethyl acrylate, n-propyl acrylate, lauryl acrylate, and 2-ethylhexyl acrylate, methyl methacrylate, n-propyl methacrylate, laurylmethacrylate, and 2-ethylhexyl methacrylate; nitrogen-containing acryls such as dimethylaminoethyl methacrylate; vinyl nitriles such as acrylonitrile and methacrylonitrile; vinyl pyridines such as 2-vinyl pyridine and 4-vinyl pyridine; vinyl ethers such as vinylmethyl ether and vinyl isobutyl ether; vinyl ketones such as vinyl methyl ketone, vinyl ethyl ketone, and vinyl isopropenyl ketone; olefins such as ethylene and propylene; vinyl-based fluorine-containing monomers such as vinylidene fluoride, tetrafluoroethylene, and hexafluoroethylene; and the like, silicone resins including methyl silicone, methylphenyl silicone, or the like, polyesters including bisphenol, glycol, or the like, an epoxy resin, a polyurethane resin, a polyamide resin, a cellulose resin, a polyether resin, and a polycarbonate resin. These resins may be used alone or in combination of two or more kinds. The coating amount of the coating resin is preferably in the range of from 0.1 part by mass to 10 parts by mass based on 100 parts by mass of the core particle and more preferably in the range of from 0.5 part by mass to 3.0 parts by mass.

A heating kneader, a heating Henschel mixer, an UM mixer, and the like may be used to produce the carrier. A heating flow-rolling bed, a heating kiln, and the like may be used depending on the amount of coating resin.

The mixing ratio of the electrostatic charge image developing toner according to this exemplary embodiment and the carrier in the electrostatic charge image developing developer is not particularly limited and may be appropriately selected depending on the purpose.

Toner Cartridge

A toner cartridge according to this exemplary embodiment is not particularly limited, as long as it includes the electrostatic charge image developing toner according to this exemplary embodiment. The toner cartridge is detachable from, for example, an image forming apparatus having a developing unit and accommodates the electrostatic charge image developing toner according to this exemplary embodiment as a toner to be supplied to the developing unit.

Developer Cartridge

A developer cartridge according to this exemplary embodiment is not particularly limited, as long as it includes the electrostatic charge image developing developer including the electrostatic charge image developing toner according to this exemplary embodiment. The developer cartridge is detachable from, for example, an image forming apparatus having a developing unit and accommodates the electrostatic charge image developing developer including the electrostatic charge image developing toner according to this exemplary embodiment as a developer to be supplied to the developing unit.

Process Cartridge

A process cartridge according to this exemplary embodiment includes an image holding member and a developing unit that develops an electrostatic latent image formed on the surface of the image holding member by the use of the developer to form a toner image. The process cartridge according to this exemplary embodiment may further include at least one selected from a group consisting of a charging unit that charges the surface of the image holding member, an electrostatic latent image forming unit that forms an electrostatic latent image on the surface of the charged surface of the image holding member, a transfer unit that transfers the toner image formed on the surface of the image holding member to a transfer medium, an image holding member cleaning unit that removes the residual toner or the like remaining on the surface of the image holding member after the transfer to clean the surface of the image holding member, and a fixing unit that fixes the toner image transferred to the transfer medium, as needed.

An exemplary configuration of the process cartridge according to this exemplary embodiment is shown in FIG. 1. The configuration will be described below. The process cartridge includes a photosensitive member (electrophotographic photoreceptor) 14 as the image holding member on which an electrostatic latent image is formed, a charging device 10 as the charging unit that charges the surface of the photosensitive member 14, a developing device 16 as the developing unit that attaches the toner to the electrostatic latent image formed on the surface of the photosensitive member 14 to form a toner image, and a cleaning blade 20 as the image holding member cleaning unit that removes and cleans the residual toner or the like remaining on the surface of the photosensitive member 14 after the transfer by coming in contact with the surface of the photosensitive member 14, which are all supported as a body, and is detachably attached to an image forming apparatus. When the process cartridge is attached to the image forming apparatus, the charging device 10, an exposing device 12 as the latent image forming unit that forms an electrostatic latent image on the surface of the photosensitive member 14 by the use of a laser beam or a beam reflected from a document, the developing device 16, a transfer roll 18 as the transfer unit that transfers the toner image on the surface of the photosensitive member 14 to a recording sheet 24 as the transfer medium, and the cleaning blade 20 are sequentially arranged around the photosensitive member 14. In FIG. 1, functional units normally necessary for other electrophotographic processes are not shown.

The operation of the process cartridge 1 according to this exemplary embodiment will be described below.

First, the surface of the photosensitive member 14 is charged by the charging device 10 (a charging process). Then, light is applied to the surface of the photosensitive member 14 by the use of the exposing device 12 and charged charges of the part to which light is applied are removed to form an electrostatic latent image (electrostatic charge image) corresponding to image information (a latent image forming process). Thereafter, the electrostatic latent image is developed by the developing device 16 to form a toner image on the surface of the photosensitive member 14 (a developing process). For example, in case of a digital electrophotographic copying machine using an organic photoreceptor as the photosensitive member 14 and using a laser as the exposing device 12, negative charges are given to the surface of the photosensitive member 14 by the charging device 10 to form a digital latent image as a dot image by the use of the laser beam and the toner is given to the part to which the laser beam is applied by the use of the developing device 16 to visualize the latent image. In this case, a minus bias voltage is applied to the developing device 16. By the use of the transfer roll 18, the recording sheet 24 as the transfer medium is superimposed on the toner image and charges having polarity opposite to that of the toner are given to the recording sheet 24 from the backside of the recording sheet 24, whereby the toner image is transferred to the recording sheet 24 through an electrostatic force (a transfer process). The transferred toner image is heated and pressurized by the fixing device having a fixing roll 22 as the fixing unit and is fused and fixed to the recording sheet 24 (a fixing process). On the other hand, the residuals such as the toner not transferred but remaining on the surface of the photosensitive member 14 are removed by the cleaning blade 20 (an image holding member cleaning process). The series of processes from the charging process to the age holding member cleaning process are finished as one cycle. In FIG. 1, the toner image is directly transferred to the recording sheet 24 through the use of the transfer roll 18, but the toner image may be transferred via an intermediate transfer medium such as an intermediate transfer belt.

For example, a charger such as a corotron shown in FIG. 1 is used as the charging device 10 as the charging unit, but a conductive or semi-conductive charging roll may be used. A contact type charger employing the conductive or semi-conductive charging roll may apply a DC current to the photosensitive member 14 or may superimpose an AC current thereon and apply the resultant thereto. For example, by causing discharge to occur in a minute space around a contact part with the photosensitive member 14 by the use of the charging device 10, the surface of the photosensitive member 14 is charged. In general, the surface of the photosensitive member is charged with the voltage range of from −300 V to −1000 V. The conductive or semi-conductive charging roll may have a single-layered structure or a multi-layered structure. A mechanism cleaning the surface of the charging roll may be further provided.

The photosensitive member 14 has at least a function of forming an electrostatic latent image (an electrostatic charge image) thereon. In the electrophotographic photoreceptor, an undercoat layer, a charge generating layer including a charge generating material, a charge transport layer including a charge transport material, and the like are sequentially formed on the outer circumferential surface of a cylindrical conductive base as needed. The stacking order of the charge generating layer and the charge transport layer may be reversed. This is a multi-layered photosensitive member in which separate layers (the charge generating layer and the charge transport layer) including the charge generating material and the charge transport material, respectively, are stacked, but a single-layered photosensitive member in which both the charge generating material and the charge transport material are included in the same layer may be used. The multi-layered photosensitive member is preferable. An intermediate layer may be disposed between the undercoat layer and a photosensitive layer. A protective layer may be disposed on the photosensitive layer. The photosensitive member is not limited to the organic photoreceptor, but another photosensitive layer such as an amorphous silicon photosensitive film may be used.

The exposing device 12 is not particularly limited and examples thereof include optical instruments such as a laser optical system and an LED array, in which the surface of the photosensitive member 14 is exposed with a light source such as a semiconductor laser beam, an LED (Light Emitting Diode) beam, or a liquid crystal shutter beam to form a desired image.

The developing unit has a function of developing an electrostatic latent image formed on the photosensitive member with a single-component developer or a two-component developer including an electrostatic charge image developing toner to form a toner image. The developing device is not particularly limited, as long as it has the above-mentioned function, and may be appropriately selected depending on the purpose. Any of a type in which a toner layer comes in contact with the photosensitive member 14 and a type in which the toner layer does not come in contact with the photosensitive member may be employed. Examples of the developing device include known developing devices such as a developing device having a function of attaching the electrostatic charge image developing toner to the photosensitive member 14 through the use of the developing device 16 as shown in FIG. 1 and a developing device having a function of attaching a toner to the photosensitive member 14 through the use of a brush or the like.

A transfer device as a transfer unit giving charges having the opposite polarity to that of the toner to a recording sheet 24 from the backside of the recording sheet 24 and transferring the toner image to the recording sheet 24 by an electrostatic force or a transfer roll and a transfer roll pressing device employing a conductive or semi-conductive roll coming indirect contact with the surface of the recording sheet 24 and transferring the toner image to the surface of the recording sheet 24 as shown in FIG. 1 may be used. ADC current may be applied to the transfer roll as a transfer current to be supplied to the image holding member or an AC current may be superimposed thereon and applied thereto. The transfer roll may be set depending on the width of an image area to be charged, the shape of a transfer charger, an aperture width, a process speed (circumferential speed), and the like. A single-layered foamed roll is suitably used as the transfer roll for the purpose of a decrease in cost. A type of directly transferring a toner image to a recording sheet 24 or a type of transferring a toner image to a recording sheet 24 via an intermediate transfer medium may be employed as the transfer type.

Any known intermediate transfer medium may be used as the intermediate transfer medium. Examples of the material used for the intermediate transfer medium include polycarbonate resin (PC), polyvinylidene fluoride (PVDF), polyalkylene phthalate, a blended material of PC/polyalkylene phthalate (PAT), and blended materials such as ethylene tetrafluoroethylene copolymer (ETFE)/PC, ETFE/PAT, and PC/PAT. The intermediate transfer belt is preferably formed of a thermosetting polyimide resin from the viewpoint of mechanical strength.

The image holding member cleaning unit may appropriately employ any of a blade cleaning type, a brush cleaning type, and a roll cleaning type, as long as it may remove and clean the residual toner and the like on the image holding member. Among these, the cleaning blade is preferably used. Examples of the material of the cleaning blade include urethane rubber, neoprene rubber, and silicone rubber. Among these, a polyurethane elastic body may be preferably used from the viewpoint of abrasion resistance.

The fixing device as the fixing unit is not particularly limited, as long as it fixes the toner image transferred to the recording sheet 24 by heating, pressurization, or heating and pressurization. For example, a fixing device including a heating roll and a pressing roll is used.

Examples of the recording sheet 24 as the transfer medium to which a toner image is transferred include regular paper and OHP sheets used in an electrophotographic copying machine or printer. To further improve the smoothness of the surface of a fixed image, the surface of a transfer medium is preferably as smooth as possible and, for example, a coated sheet in which the surface of a sheet of regular paper is coated with a resin or the like or a printing art sheet are suitably used.

In this exemplary embodiment, a sheet of paper having high water content under a high-humidity environment and coarse fiber is very suitably used. Here, the sheet of paper "having high water content under a high-humidity environment" means a sheet of paper of which the water content is in the range of from 6.5% by mass to 10% by mass, where the water content is measured through the use of a method of measuring the water content of a 50 mm square sheet piece after the sheet of paper is left under an environment of the room temperature 30° C. and 95% RH for 72 hours. The water content tends to increase when a low-temperature and low-humidity condition is changed to the high-temperature and high-humidity condition. The sheet of paper "having coarse fiber" means a sheet of paper of which the Bekk smoothness measured through the use of a method based on "JIS P8119" is in the range of from 10 to 30.

Image Forming Apparatus

An image forming apparatus according to this exemplary embodiment includes an image holding member, a charging unit that charges the surface of the image holding member, a latent image forming unit that forms an electrostatic latent image on the surface of the image holding member, a developing unit that develops the electrostatic latent image formed on the surface of the image holding member by the use of a developer to form a toner image, and a transfer unit that transfers the developed toner image to a transfer medium. The image forming apparatus according to this exemplary embodiment may further include at least one selected from a group consisting of a fixing unit that fixes the toner image transferred to the transfer medium and an image holding member cleaning unit that removes and cleans the residual toner or the like remaining on the surface of the image holding member after the transfer, as needed. The image forming apparatus according to this exemplary embodiment may employ the above-mentioned process cartridge.

Figure 2:
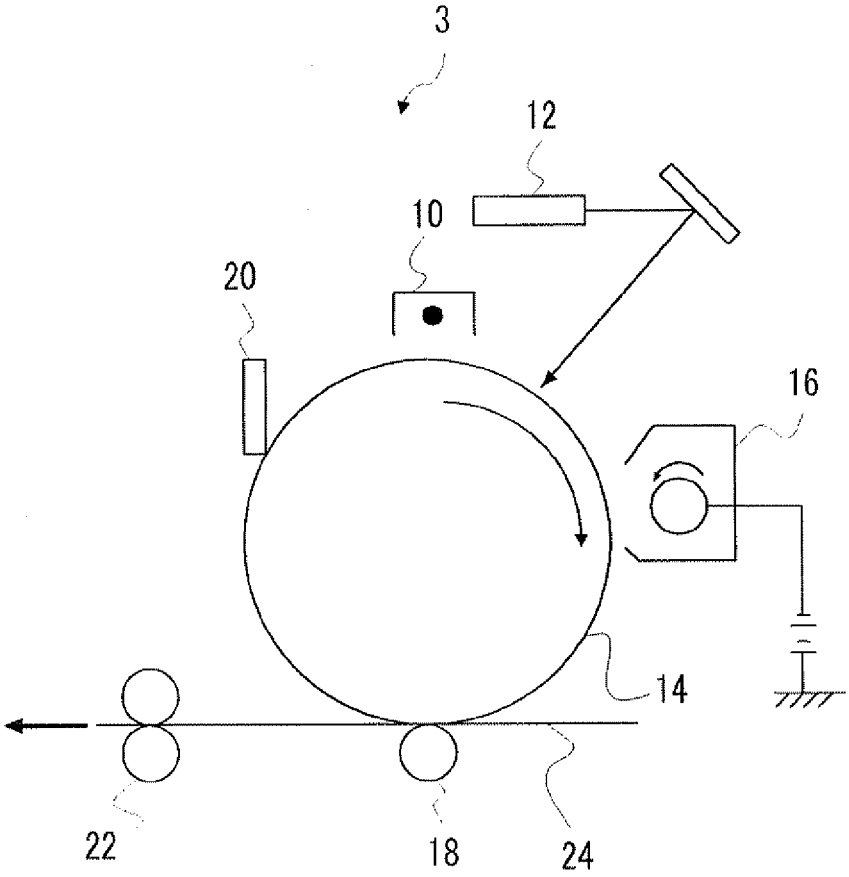
FIG. 2 is a diagram schematically illustrating the exemplary configuration of an image forming apparatus according to an exemplary embodiment of the invention.

The schematic configuration of an example of the image forming apparatus according to this exemplary embodiment is shown in FIG. 2. The configuration will be described below. The image forming apparatus 3 includes a photosensitive member 14 as the image holding member on which an electrostatic latent image is formed, a charging device 10 as the charging unit that charges the surface of the photosensitive member 14, an exposing device 12 as the latent image forming unit that forms en electrostatic latent image on the surface of the photosensitive member 14 by the use of a laser beam or a light reflected from a document, a developing device 16 as the developing unit that attaches a toner to the electrostatic latent image formed on the surface of the photosensitive member 14 to form a toner image, a transfer roll 18 as the transfer unit that transfers the toner image on the surface of the photosensitive member 14 to a recording sheet 24 as the transfer medium, and a cleaning blade 20 as the image holding member cleaning unit that comes in contact with the surface of the photosensitive member 14 to remove and clean the residual toner or the like remaining on the surface of the photosensitive member 14 after the transfer. In the image forming apparatus 3, the charging device 10, the exposing device 12, the developing device 16, the transfer roll 18, and the cleaning blade 20 are sequentially arranged around the photosensitive member 14. The image forming apparatus further includes a fixing device having a fixing roll 22 as the fixing unit. In FIG. 2, functional units normally necessary for other electrophotographic processes are not shown. The configuration and the image forming operation of the image forming apparatus 3 are the same as the process cartridge 1 shown in FIG. 1.

The configurations of the process cartridge and the image forming apparatus according to this exemplary embodiment are not limited to the above-mentioned configurations, and configurations known in the past as the configurations of a process cartridge and an image forming apparatus of an electrophotographic type may be employed. That is, the charging unit, the latent image forming unit, the developing unit, the transfer unit, the image holding member cleaning unit, an erasing unit, a sheet supplying unit, a transport unit, and an image control unit appropriately employ known ones as needed. These configurations are not particularly limited in this exemplary embodiment.

Image Forming Method

The image forming method of the exemplary embodiment of the invention includes, charging the surface of an image holding member, forming an electrostatic latent image on the surface of the image holding member, developing the electrostatic latent image formed on the surface of the image holding member by the use of the electrostatic charge image developing developer to form a toner image, and transferring the developed toner image to a transfer medium.

EXAMPLES

The invention will be described below in more detail with reference to examples and comparative examples, but the invention is not limited to the below-described examples.

Preparation of Binder Resin Dispersion 1
(Preparation of Resin Particle Dispersion)

Bisphenol A ethylene oxide adduct: 21.5 parts by mass
Bisphenol A propylene oxide adduct: 50.7 parts by mass
Terephthalic acid: 23.9 parts by mass
Dodecenyl succinic anhydride: 4.1 parts by mass
Fumaric acid: 10.6 parts by mass These components are input to a flask, the temperature is raised to 200° C. for two hours, and 1.3 parts by mass of tin dibutyl oxide is input thereto after it is confirmed that the inside of the reaction system is stirred. The temperature is raised to 240° C. from the present temperature for 5.5 hours while removing the produced water, and the dehydration and condensation reaction is continued at 240° C. for 5 hours, whereby Amorphous Polyester Resin 1 having a weight-average molecular weight of 65,000 is obtained.

Then, the resultant in the melted state is fed to a Cavitron CD1010 (made by Eurotech Co., Ltd.) at a rate of 100 g per minute. Diluted aqueous ammonia with a concentration of 0.37% by mass which is obtained by diluting sample aqueous ammonia with ion-exchanged water is input to a separately-prepared aqueous medium tank and is fed to the Cavitron along with the polyester resin melt at a rate of 0.1 L per minute while heating the diluted aqueous ammonia to 120° C. by the use of a heat exchanger. The Cavitron is operated under the conditions of a rotation speed of a rotor of 60 Hz and a pressure of 5 kg/cm$^2$, whereby binder resin dispersion 1 with a solid content of 38.5% by mass is obtained.

Preparation of Binder Resin Dispersion 2
(Preparation of Resin Particle Dispersion)

Dodecane dimethyl dioate: 145 parts by mass
1,9-nonane diol: 72 parts by mass

These components are input to a flask, the temperature is raised to 180° C. for 1.5 hours, and 0.6 part by mass of titanium tetrabutoxide is input thereto after it is confirmed that the inside of the reaction system is stirred. The temperature is raised to 230° C. from the present temperature for 4 hours while removing the produced water, and the dehydration and condensation reaction is continued at 230° C. for 2 hours, whereby crystalline polyester resin 1 having a weight-average molecular weight of 30,000 is obtained.

Then, the resultant in the melted state is fed to a Cavitron CD1010 (made by Eurotech Co., Ltd.) at a rate of 100 g per minute. Diluted aqueous ammonia with a concentration of 0.37% by mass which is obtained by diluting sample aqueous ammonia with ion-exchanged water is input to a separately-prepared aqueous medium tank and is fed to the Cavitron along with the polyester resin melt at a rate of 0.1 L per minute while heating the diluted aqueous ammonia to 120° C. by the use of a heat exchanger. The Cavitron is operated under the conditions of a rotation speed of a rotor of 60 Hz and a pressure of 5 kg/cm$^2$, whereby binder resin dispersion 2 with a solid content of 32.6% by mass is obtained.

Preparation of Binder Resin Dispersion 3

Styrene: 450 parts by mass
n-butyl acrylate: 157 parts by mass
Acrylic acid: 14 parts by mass
Dodecane diol: 11 parts by mass These components are mixed and dissolved to prepare a solution. 12 parts by mass of an anionic surfactant (DOWFAX made by Dow Chemical Co.) is dissolved in 257 parts by mass of ion-exchanged water and the solution is added thereto, the resultant is dispersed and emulsified in the flask (monomer emulsion A). 1 part by mass of the anionic surfactant (DOWFAX made by Dow Chemical Co.) is dissolved in 549 parts by mass of ion-exchanged water in the same way and the resultant is input to a polymerization flask. The polymerization flask is sealed, a reflux tube is installed, the inner contents thereof are slowly stirred while supplying nitrogen thereto, and the polymerization flask is heated to 75° C. in a water bath and is retained. 9 parts by mass of ammonium persulfate is dissolved in 86 parts by mass of ion-exchanged water, the resultant is dropped to the polymerization flask by the use of a constant rate pump for 20 minutes, and monomer emulsion A is dropped thereto by the use of the constant rate pump for 200 minutes. Thereafter, the polymerization flask is retained at 75° C. for 3.5 hours while slowly stirring the resultant and then the polymerization is finished. As a result, binder resin dispersion 3 with a solid content of 33.8% by mass is obtained.

Preparation of Pigment Dispersion (Preparation of Colorant Particle Dispersion)

Carbon black (R330 made by CABOT Corporation): 80 parts by mass
Anionic surfactant (DOWFAX made by Dow Chemical Co.): 10 parts by mass
Ion-exchanged water: 245 parts by mass These components are mixed and are dispersed by the use of a homogenizer (ULTRA-TURRAX T50 made by IKA Laboratory) for 20 minutes and a pigment dispersion with a solid content of 24.7% by mass is prepared through the use of a circulating ultrasonic disperser (RUS-600 TCVP made by Nippon Seiki Co., Ltd.).

Preparation of Release Agent Dispersion
(Preparation of Release Agent Particle Dispersion)

Release agent (FT105 made by Nippon Seiro Co., Ltd.): 90 parts by mass
Anionic surfactant (DOWFAX made by Dow Chemical Co.): 15 parts by mass
Ion-exchanged water: 270 parts by mass These components are mixed and are dispersed by the use of a homogenizer (ULTRA-TURRAX T50 made by IKA Laboratory) for 20 minutes and a release agent dispersion with a solid content of 25.2% by mass is prepared through the use of a circulating ultrasonic disperser (RUS-600 TCVP made by Nippon Seiki Co., Ltd.).

Production of Toner Particle 1

Binder resin dispersion 1: 179.7 parts by mass
Binder resin dispersion 2: 52.5 parts by mass
Pigment dispersion: 26.9 parts by mass
Release agent dispersion: 28.1 parts by mass
Surfactant (DOWFAX made by Dow Chemical Co.): 7 parts by mass
Ion-exchanged water: 500 parts by mass These components are mixed and dispersed in an annular stainless flask by the use of a homogenizer (ULTRA-TURRAX T50 made by IKA Laboratory). Thereafter, 13 parts by mass of 10% by mass aluminum sulfate aqueous solution is added to the dispersion by the use of a water bath and the contents in the flask are stirred. After it is confirmed that the contents are dispersed, the resultant is stirred at a stirring rotation speed of 150 rpm by the use of a three-one motor (BLh300 made by Shinto Scientific Co., Ltd.) and the resultant is heated and stirred to 44° C. at a temperature-rising rate of 0.5° C./min and is retained at 44° C. for 35 minutes.

Thereafter, 65.2 parts by mass of binder resin dispersion 1 is added thereto and is stirred for 40 minutes. By observing the resultant through the use of an optical microscope, it is confirmed that aggregated particles with a particle diameter of 6.0 μm are generated. The pH is adjusted to 7.5 by the use of 0.8 M sodium hydroxide aqueous solution. Thereafter, the temperature is lowered to 27° C. and the resultant is then retained for 33 hours. Thereafter, the temperature is raised at a temperature-rising rate of 0.5° C./minute, 13 parts by mass of 22% by mass 3-hydroxy-2,2'-iminodisuccinic acid (HIDS) solution is added thereto when the temperature reaches 90° C., and the aggregates are then coalesced for 5 hours, are cooled, are filtrated, are sufficiently washed with ion-exchanged water, and are then dried, whereby Toner Particle 1 with a volume-average particle diameter of 5.9 μm is obtained.

Production of Toner 1

Commercially-available fumed silica RX 50 (made by Nippon Aerosil Co., Ltd., with a number-average particle diameter D50 of 40 nm) is prepared. 3 parts by mass of the fumed silica RX 50 (made by Nippon Aerosil Co., Ltd., with a number-average particle diameter D50 of 40 nm) is added as an external additive to 100 parts by mass of Toner Particle 1, the resultant is blended at a rotation speed of 45 m/s by the use of a Henschel mixer for 10 minutes, and coarse particles are removed by the use of a sieve of 45 μm mesh, whereby Toner 1 is obtained.

Production of Toner Particle 2

Toner Particle 2 is obtained by the use of the same method as producing Toner Particle 1, except that the retention time after the pH is adjusted to 7.5 by the use of the 0.8 M sodium hydroxide aqueous solution and the temperature is then lowered to 27° C. is changed to 40 hours.

Production of Toner 2

Toner 2 is obtained by the use of the same method as producing Toner 1, except that Toner Particle 2 is used instead of Toner Particle 1.

Production of Toner Particle 3

Toner Particle 3 is obtained by the use of the same method as producing Toner Particle 1, except that the retention time after the pH is adjusted to 7.5 by the use of the 0.8 M sodium hydroxide aqueous solution and the temperature is then lowered to 27° C. is changed to 43 hours.

Production of Toner 3

Toner 3 is obtained by the use of the same method as producing Toner 1, except that Toner Particle 3 is used instead of Toner Particle 1.

Production of Toner Particle 4

Toner Particle 4 is obtained by the use of the same method as producing Toner Particle 1, except that the retention time after the pH is adjusted to 7.5 by the use of the 0.8 M sodium hydroxide aqueous solution and the temperature is then lowered to 27° C. is changed to 48 hours.

Production of Toner 4

Toner 4 is obtained by the use of the same method as producing Toner 1, except that Toner Particle 4 is used instead of Toner Particle 1.

Production of Toner Particle 5

Toner Particle 5 is obtained by the use of the same method as producing Toner Particle 1, except that the retention time after the pH is adjusted to 7.5 by the use of the 0.8 M sodium hydroxide aqueous solution and the temperature is then lowered to 27° C. is changed to 49 hours.

Production of Toner 5

Toner 5 is obtained by the use of the same method as producing Toner 1, except that Toner Particle 5 is used instead of Toner Particle 1.

Production of Toner Particle 6

Toner Particle 6 is obtained by the use of the same method as producing Toner Particle 1, except that the retention time after the pH is adjusted to 7.5 by the use of the 0.8 M sodium hydroxide aqueous solution and the temperature is then lowered to 27° C. is changed to 57 hours.

Production of Toner 6

Toner 6 is obtained by the use of the same method as producing Toner 1, except that Toner Particle 6 is used instead of Toner Particle 1.

Production of Toner Particle 7

Toner Particle 7 is obtained by the use of the same method as producing Toner Particle 1, except that the amount of 10% by mass aluminum sulfate aqueous solution is changed to 10 parts by mass.

Production of Toner 7

Toner 7 is obtained by the use of the same method as producing Toner 1, except that Toner Particle 7 is used instead of Toner Particle 1.

Production of Toner Particle 8

Toner Particle 8 is obtained by the use of the same method as producing Toner Particle 1, except that the amount of 10% by mass aluminum sulfate aqueous solution is changed to 15 parts by mass.

Production of Toner 8

Toner 8 is obtained by the use of the same method as producing Toner 1, except that Toner Particle 8 is used instead of Toner Particle 1.

Production of Toner Particle 9

Toner Particle 9 is obtained by the use of the same method as producing Toner Particle 1, except that the amount of 10% by mass aluminum sulfate aqueous solution is changed to 9 parts by mass.

Production of Toner 9

Toner 9 is obtained by the use of the same method as producing Toner 1, except that Toner Particle 9 is used instead of Toner Particle 1.

Production of Toner Particle 10

Toner Particle 10 is obtained by the use of the same method as producing Toner Particle 1, except that the amount of 10% by mass aluminum sulfate aqueous solution is changed to 17 parts by mass.

Production of Toner 10

Toner 10 is obtained by the use of the same method as producing Toner 1, except that Toner Particle 10 is used instead of Toner Particle 1.

Production of Toner Particle 11

Toner Particle 11 is obtained by the use of the same method as producing Toner Particle 1, except that the amount of 10% by mass aluminum sulfate aqueous solution is changed to 8 parts by mass.

Production of Toner 11

Toner 11 is obtained by the use of the same method as producing Toner 1, except that Toner Particle 11 is used instead of Toner Particle 1.

Production of Toner Particle 12

Toner Particle 12 is obtained by the use of the same method as producing Toner Particle 1, except that the amount of 10% by mass aluminum sulfate aqueous solution is changed to 18 parts by mass.

Production of Toner 12

Toner 12 is obtained by the use of the same method as producing Toner 1, except that Toner Particle 12 is used instead of Toner Particle 1.

Production of Toner Particle 13

Toner Particle 13 is obtained by the use of the same method as producing Toner Particle 1, except that the amount of 22% by mass BIDS aqueous solution is changed to 0 parts by mass.

Production of Toner 13

Toner 13 is obtained by the use of the same method as producing Toner 1, except that Toner Particle 13 is used instead of Toner Particle 1.

Production of Toner Particle 14

Toner Particle 14 is obtained by the use of the same method as producing Toner Particle 1, except that the amount of Binder Resin Dispersion 1 is changed to 208.6 parts by mass and the amount of Binder Resin Dispersion 2 is changed to 18.4 parts by mass.

Production of Toner 14

Toner 14 is obtained by the use of the same method as producing Toner 1, except that Toner Particle 14 is used instead of Toner Particle 1.

Production of Toner Particle 15

Toner Particle 15 is obtained by the use of the same method as producing Toner Particle 1, except that the amount of Binder Resin Dispersion 1 is changed to 141 parts by mass and the amount of Binder Resin Dispersion 2 is changed to 98.2 parts by mass.

Production of Toner 15

Toner 15 is obtained by the use of the same method as producing Toner 1, except that Toner Particle 15 is used instead of Toner Particle 1.

Production of Toner Particle 16

Toner Particle 16 is obtained by the use of the same method as producing Toner Particle 1, except that the amount of Binder Resin Dispersion 1 is changed to 223.4 parts by mass and the amount of Binder Resin Dispersion 2 is changed to 1 part by mass.

Production of Toner 16

Toner 16 is obtained by the use of the same method as producing Toner 1, except that Toner Particle 16 is used instead of Toner Particle 1.

Production of Toner Particle 17

Toner Particle 17 is obtained by the use of the same method as producing Toner Particle 1, except that the amount of Binder Resin Dispersion 1 is changed to 99.5 parts by mass and the amount of Binder Resin Dispersion 2 is changed to 147 parts by mass.

Production of Toner 17

Toner 17 is obtained by the use of the same method as producing Toner 1, except that Toner Particle 17 is used instead of Toner Particle 1.

Production of Toner Particle 18

Toner Particle 18 is obtained by the use of the same method as producing Toner Particle 1, except that the amount of Binder Resin Dispersion 1 is changed to 224.2 parts by mass and the amount of Binder Resin Dispersion 2 is changed to 0 parts by mass.

Production of Toner 18

Toner 18 is obtained by the use of the same method as producing Toner 1, except that Toner Particle 18 is used instead of Toner Particle 1.

Production of Toner Particle 19

Toner Particle 19 is obtained by the use of the same method as producing Toner Particle 1, except that the amount of Binder Resin Dispersion 1 is changed to 89.1 parts by mass and the amount of Binder Resin Dispersion 2 is changed to 160 parts by mass.

Production of Toner 19

Toner 19 is obtained by the use of the same method as producing Toner 1, except that Toner Particle 19 is used instead of Toner Particle 1.

Production of Toner Particle 20

Toner Particle 20 is obtained by the use of the same method as producing Toner Particle 1, except that the amount of 10% by mass aluminum sulfate aqueous solution is changed to 10 parts by mass and the amount of 22 by mass HIDS aqueous solution is changed to 4.5 parts by mass.

Production of Toner 20

Toner 20 is obtained by the use of the same method as producing Toner 1, except that Toner Particle 20 is used instead of Toner Particle 1.

Production of Toner Particle 21

Toner Particle 21 is obtained by the use of the same method as producing Toner Particle 1, except that the amount of 22% by mass HIDS aqueous solution is changed to 3.7 parts by mass.

Production of Toner 21

Toner 21 is obtained by the use of the same method as producing Toner 1, except that Toner Particle 21 is used instead of Toner Particle 1.

Production of Toner Particle 22

Toner Particle 22 is obtained by the use of the same method as producing Toner Particle 1, except that the amount of 10% by mass aluminum sulfate aqueous solution is changed to 14 parts by mass and the amount of 22% by mass HIDS aqueous solution is changed to 6.4 parts by mass.

Production of Toner 22

Toner 22 is obtained by the use of the same method as producing Toner 1, except that Toner Particle 22 is used instead of Toner Particle 1.

Production of Toner Particle 23

Toner Particle 23 is obtained by the use of the same method as producing Toner Particle 1, except that the amount of 10% by mass aluminum sulfate aqueous solution is changed to 14 parts by mass and the amount of 22% by mass HIDS aqueous solution is changed to 3.5 parts by mass.

Production of Toner 23

Toner 23 is obtained by the use of the same method as producing Toner 1, except that Toner Particle 23 is used instead of Toner Particle 1.

Production of Toner Particle 24

Toner Particle 24 is obtained by the use of the same method as producing Toner Particle 1, except that the amount of 10% by mass aluminum sulfate aqueous solution is changed to 19 parts by mass and the amount of 22% by mass HIDS aqueous solution is changed to 7.6 parts by mass.

Production of Toner 24

Toner 24 is obtained by the use of the same method as producing Toner 1, except that Toner Particle 24 is used instead of Toner Particle 1.

Production of Toner Particle 25

Toner Particle 25 is obtained by the use of the same method as producing Toner Particle 1, except that the amount of 10% by mass aluminum sulfate aqueous solution is changed to 15 parts by mass and the amount of 22% by mass HIDS aqueous solution is changed to 2.9 parts by mass.

Production of Toner 25

Toner 25 is obtained by the use of the same method as producing Toner 1, except that Toner Particle 25 is used instead of Toner Particle 1.

Production of Toner Particle 26

Toner Particle 26 is obtained by the use of the same method as producing Toner Particle 1, except that the 10% by mass aluminum sulfate aqueous solution is changed to 10% by mass magnesium sulfate.

Production of Toner 26

Toner 26 is obtained by the use of the same method as producing Toner 1, except that Toner Particle 26 is used instead of Toner Particle 1.

Production of Toner Particle 27

Toner Particle 27 is obtained by the use of the same method as producing Toner Particle 1, except that the 10% by mass aluminum sulfate aqueous solution is changed to 10% by mass ferric chloride.

Production of Toner 27

Toner 27 is obtained by the use of the same method as producing Toner 1, except that Toner Particle 27 is used instead of Toner Particle 1.

Production of Toner Particle 28

Toner Particle 28 is obtained by the use of the same method as producing Toner Particle 1, except that the retention time after the pH is adjusted to 7.5 by the use of the 0.8 M sodium hydroxide aqueous solution and the temperature is then lowered to 27° C. is changed to 59 hours.

Production of Toner 28

Toner 28 is obtained by the use of the same method as producing Toner 1, except that Toner Particle 28 is used instead of Toner Particle 1.

Production of Toner Particle 29

Toner Particle 29 is obtained by the use of the same method as producing Toner Particle 1, except that the retention time after the pH is adjusted to 7.5 by the use of the 0.8 M sodium hydroxide aqueous solution and the temperature is then lowered to 27° C. is changed to 31 hours.

Production of Toner 29

Toner 29 is obtained by the use of the same method as producing Toner 1, except that Toner Particle 29 is used instead of Toner Particle 1.

Production of Toner Particle 30

Toner Particle 30 is obtained by the use of the same method as producing Toner Particle 1, except that 179.7 parts by mass of Binder Resin Dispersion 1 is changed to 205.1 parts by mass of Binder Resin Dispersion 3.

Production of Toner 30

Toner 30 is obtained by the use of the same method as producing Toner 1, except that Toner Particle 30 is used instead of Toner Particle 1.

Production of Toner Particle 31

Toner Particle 31 is obtained by the use of the same method as producing Toner Particle 1, except that the aging is not performed.

Production of Toner 31

Toner 31 is obtained by the use of the same method as producing Toner 1, except that Toner Particle 31 is used instead of Toner Particle 1.

Production of Toner Particle 32

Toner Particle 32 is obtained by the use of the same method as producing Toner Particle 30, except that the aging is not performed.

Production of Toner 32

Toner 32 is obtained by the use of the same method as producing Toner 1, except that Toner Particle 32 is used instead of Toner Particle 1.

Production of Toner Particle 33

Amorphous Polyester Resin 1: 50 parts by mass

Carbon Black R330 made by CABOT Corporation): 7 parts by mass

Release agent (FT105 made by Nippon Seiro Co., Ltd.): 5 parts by mass

These materials are heated to 70° C. and are melted and are then melted and kneaded in an extruder at a set temperature of 150°, at a screw rotation speed of 280 rpm, and at a feed speed of 220 kg/h. The resultant is cooled, is then coarsely pulverized, and is then pulverized by the use of a jet mill, and the pulverized material is air-classified, whereby Toner Particles 33 with a volume-average diameter of 6.5 μm.

Production of Toner 33

Toner 33 is obtained by the use of the same method as producing Toner 1, except that Toner Particle 33 is used instead of Toner Particle 1.

EVALUATION

Analysis and Evaluation of Toner

The toners in the examples are analyzed and evaluated as follows. The results are described in Table 1.

Measurement of Conductivity of solution when Toner Particles are Dissolved with THF Measurement of Contents of Metal Element originating from Aggregating Agent and Carbon Element and Oxygen Element in Toner Particle Measurement of Flow Tester Half-flow Temperature of Toner Particle Measurement of HIDS in Toner Particle Measurement of Conductivity of Solution when Dissolved with THE The conductivity is measured as follows.

(1) 0.1 g of a toner is weighed and 30 mL of tetrahydrofuran (special grade) is added thereto, and the resultant is mixed and stirred by the use of a magnetic stirrer for 1 hour.

(2) Thereafter, the resultant (1) is centrifuged a 2000 rpm by the use of a centrifuge for 30 minutes.

(3) The supernatant solution obtained in (2) is separated into solid and liquid by the use of a filter paper of JIS standard 5A.

(4) The conductivity of the filtrate obtained in (3) is measured by the use of a conductivity meter (SevenGo pro SG7 made by Mettler-Toledo International Inc.).

Measurement of HIDS

It is checked as follows whether HIDS is included in the toner particles.

(1) 0.1 g of a toner is weighed, 50 mL of 0.5 M NaOH aqueous solution and an appropriate amount of 20% surfactant (TAYCA POWER) are added thereto, and the resultant is mixed and stirred at 28° C. by the use of a ball mill for 2 hours.

(2) Thereafter, the resultant (1) is centrifuged at 2000 rpm by the use of a centrifuge for 30 minutes.

(3) The supernatant solution obtained in (2) is separated into solid and liquid by the use of a filter paper of JIS standard 5A.

(4) 8.5 mL of the filtrate obtained in (3), 1.0 mL of an acetic acid buffer (which is obtained by sufficiently mixing 20.0 mL of 1 M acetic acid, 30.0 mL of 1 M sodium acetate, and 100 mL, of ion-exchanged water), and 0.5 mL of 0.19% by mass iron (III) chloride are weighed into a conical flask and are sufficiently mixed.

(5) The sample obtained in (4) is measured by the use of a high performance liquid chromatograph (HPLC) under the following conditions and it is checked whether HIDS is included in the dispersion.

Analyzer: LaChromElite L-2000 series made by Hitachi High Technologies Corporation Column: HITACHI GL-W520-S (ϕ7.8 mm×300 mm)

Detector: L-2455 type diode array detector

Measuring wavelength: UV 190 to 400 nm

Quantitative wavelength: UV 284 nm

Mobile phase: 50 mM dibasic potassium phosphate

Liquid feed speed: 1.0 mL/min

Amount of sample: 10 μL

Column temperature: 50° C.

Measurement of Contents of Metal Element Originating from Aggregating Agent and Carbon Element and Oxygen Element in Toner Particle The methods and conditions for measuring the net intensity of the elements using the fluorescent X-ray analysis are as follows. As a pre-process of measuring samples, 0.12 g of a toner is subjected to pressure molding under a pressurizing condition of 6 metric ton and 1 minute by the use of a pressure molding machine. Under the measuring conditions of a tube voltage of 40 KV and a tube current of 70 mA, the resultant is measured in the overall element analysis by the use of a fluorescent X-ray analyzer (XRF-1500) made by Shimadzu Corp.

Measurement of Flow Tester Half-Flow Temperature of Toner Particle

The measurement of a flow tester half-flow temperature is performed by the use of a KOKA type flow tester CFT-500C (made by Shimadzu Corp.). The temperature is defined as a temperature corresponding to a half of the height from a flow start point to a flow endpoint when 1.1 g of a sample is melted and made to flow under the conditions of a dice pore diameter of 0.5 mitt, a dice pore length of 1 mm, a pressurization load of 0.98 MPa (10 kg/cm$^2$), a pre-heating time of 5 minutes, a temperature-rising rate of 1° C./min, a measurement temperature interval of 1° C., and a start temperature of 65° C.

Evaluation of Image Quality

Production of Developer 100 parts by mass of the obtained carriers are added to 5 parts by mass of the toners obtained in the examples, the resultants are mixed at 40 rpm by the use of a V blender for 20 minutes, and the resultants are sieved by the use of a sieve having 177 μm meshes, whereby developers are obtained.

The following is used as the carriers.

Ferrite particles (with a volume-average particle diameter of 50 μm: 100 parts by mass Toluene: 14 parts by mass Styrene-methyl methacrylate copolymer (with a mole ratio of 90/10 and Mw=80,000): 2 parts by mass Carbon black (R330 made by CABOT Corporation): 0.2 Part by mass First, the components other than the ferrite particles are stirred and dispersed by the use of a stirrer for 10 minutes to prepare a coating solution, the coating solution and the ferrite particles are input to a vacuum-deaeration kneader and are stirred at 60° C. for 30 minutes, and the resultant is decompressed, deaerated, and dried while raising the temperature, whereby the carrier is obtained.

Evaluation of Durability of Fixed Image

The obtained developer is filled in a developing device of a color copying machine DocuCentreColor 400 (made by Fuji Xerox Co., Ltd), the amount of toner applied is adjusted to 0.45 mg/cm$^2$, and a non-fixed image is printed out. The printed image is a solid image of which an image density of a 50 mm×50 mm size is 100% and "OK Muse Cotton 0.17 mm" (with a water content of 7.5% by mass and a Bekk smoothness of 21, made by Daio Paper Corp.) is used as a sheet of paper. In the fixation of an image, a fixing device taken out of a monochrome copying machine DocuCentre f1100 (made by Fuji Xerox Co., Ltd.) is modified to change the temperature of the roll of the fixing device and the non-fixed image is fixed at a sheet feeding speed of the fixing device of 460 mm/sec while changing the temperature of the fixing device from 140° C. to 210° C. by 5° C., whereby fixed images are obtained. The fixed image parts obtained at the lowest fixing temperature (at the lowest temperature at which low-temperature offset is not generated) are folded by weight and a grade is given depending on degrees of image loss of the parts. The evaluation criterion is as follows. The results are described in Table 1.

G1: No image loss is generated and the image intensity is high.

G2: The image loss is generated only in the fold part and the image intensity is high, which is allowable.

G3: The image loss is generated in the fold part and in the vicinity thereof but is small, which is allowable.

G4: The image loss is generated in the fold part and in the vicinity thereof, which is allowable.

G5: The image loss is generated in the fold part and in the vicinity thereof, which is not allowable.

TABLE 1

| | | Resin Dispersion | Content of resin dispersion (parts) | Content of resin dispersion 2 -(parts) | Content of 22% HIDS (parts) | Type of aggregating agent | Amount of aggregating agent (parts) | Cm (%) | Cc (%) | Co (%) | Cm/(Cc + Co) (%) | Conductivity of THF soluble (μS/cm) | Flow tester half-flow temperature (° C.) | Aging time (h) | Halftone image intensity |
|---|---|---|---|---|---|---|---|---|---|---|---|---|---|---|---|
| Ex. 1 | Toner 1 | (1) | 179.7 | 17 | 4.3 | Aluminum sulfate | 13 | 0.059 | 78.11 | 21.55 | 0.059 | 28 | 136 | 33 | G1 |
| Ex. 2 | Toner 2 | (1) | 179.7 | 17 | 4.3 | Aluminum sulfate | 13 | 0.057 | 77.98 | 21.61 | 0.057 | 43 | 135 | 40 | G1 |
| Ex. 3 | Toner 3 | (1) | 179.7 | 17 | 4.3 | Aluminum sulfate | 13 | 0.059 | 78.43 | 21.15 | 0.059 | 54 | 134 | 43 | G2 |
| Ex. 4 | Toner 4 | (1) | 179.7 | 17 | 4.3 | Aluminum sulfate | 13 | 0.064 | 78.22 | 21.34 | 0.064 | 98 | 137 | 48 | G2 |
| Ex. 5 | Toner 5 | (1) | 179.7 | 17 | 4.3 | Aluminum sulfate | 13 | 0.061 | 78.61 | 20.97 | 0.061 | 103 | 131 | 49 | G3 |
| Ex. 6 | Toner 6 | (1) | 179.7 | 17 | 4.3 | Aluminum sulfate | 13 | 0.060 | 78.55 | 21.11 | 0.060 | 141 | 137 | 57 | G3 |
| Ex. 7 | Toner 7 | (1) | 179.7 | 17 | 4.3 | Aluminum sulfate | 10 | 0.037 | 78.24 | 21.37 | 0.037 | 43 | 134 | 33 | G2 |
| Ex. 8 | Toner 8 | (1) | 179.7 | 17 | 4.3 | Aluminum sulfate | 15 | 0.083 | 77.95 | 21.60 | 0.083 | 27 | 131 | 33 | G2 |
| Ex. 9 | Toner 9 | (1) | 179.7 | 17 | 4.3 | Aluminum sulfate | 9 | 0.099 | 78.09 | 21.49 | 0.099 | 33 | 136 | 33 | G3 |
| Ex. 10 | Toner 10 | (1) | 179.7 | 17 | 4.3 | Aluminum sulfate | 17 | 0.012 | 78.11 | 21.40 | 0.012 | 27 | 139 | 33 | G3 |
| Ex. 11 | Toner 11 | (1) | 179.7 | 17 | 4.3 | Aluminum sulfate | 8 | 0.008 | 78.37 | 21.21 | 0.008 | 46 | 133 | 33 | G4 |
| Ex. 12 | Toner 12 | (1) | 179.7 | 17 | 4.3 | Aluminum sulfate | 18 | 0.103 | 78.01 | 21.58 | 0.103 | 35 | 134 | 33 | G4 |
| Ex. 13 | Toner 13 | (1) | 179.7 | 17 | 0.0 | Aluminum sulfate | 13 | 0.063 | 77.89 | 21.58 | 0.063 | 50 | 139 | 33 | G2 |
| Ex. 14 | Toner 14 | (1) | 208.6 | 6 | 4.3 | Aluminum sulfate | 13 | 0.057 | 77.94 | 21.55 | 0.057 | 30 | 131 | 33 | G2 |
| Ex. 15 | Toner 15 | (1) | 141 | 32 | 4.3 | Aluminum sulfate | 13 | 0.063 | 77.93 | 21.60 | 0.063 | 23 | 134 | 33 | G2 |
| Ex. 16 | Toner 16 | (1) | 223.4 | 0.3 | 4.3 | Aluminum sulfate | 13 | 0.058 | 78.08 | 21.53 | 0.058 | 22 | 138 | 33 | G3 |
| Ex. 17 | Toner 17 | (1) | 99.5 | 48 | 4.3 | Aluminum sulfate | 13 | 0.062 | 78.10 | 21.56 | 0.062 | 20 | 132 | 33 | G3 |
| Ex. 18 | Toner 18 | (1) | 224.2 | 0 | 4.3 | Aluminum sulfate | 13 | 0.062 | 78.03 | 21.55 | 0.062 | 38 | 137 | 33 | G4 |
| Ex. 19 | Toner 19 | (1) | 89.1 | 52 | 4.3 | Aluminum sulfate | 13 | 0.057 | 78.31 | 21.34 | 0.057 | 38 | 134 | 33 | G4 |
| Ex. 20 | Toner 20 | (1) | 179.7 | 17 | 4.5 | Aluminum sulfate | 10 | 0.060 | 77.63 | 22.00 | 0.060 | 33 | 126 | 33 | G2 |
| Ex. 21 | Toner 21 | (1) | 179.7 | 17 | 3.7 | Aluminum sulfate | 13 | 0.065 | 78.01 | 21.60 | 0.065 | 33 | 145 | 33 | G2 |
| Ex. 22 | Toner 22 | (1) | 179.7 | 17 | 6.4 | Aluminum sulfate | 14 | 0.064 | 78.21 | 21.31 | 0.064 | 38 | 122 | 33 | G3 |
| Ex. 23 | Toner 23 | (1) | 179.7 | 17 | 3.5 | Aluminum sulfate | 14 | 0.056 | 78.30 | 21.22 | 0.056 | 39 | 147 | 33 | G3 |
| Ex. 24 | Toner 24 | (1) | 179.7 | 17 | 7.6 | Aluminum sulfate | 19 | 0.060 | 78.22 | 21.43 | 0.060 | 50 | 117 | 33 | G4 |
| Ex. 25 | Toner 25 | (1) | 179.7 | 17 | 2.9 | Aluminum sulfate | 15 | 0.054 | 77.80 | 21.71 | 0.054 | 45 | 151 | 33 | G4 |
| Ex. 26 | Toner 26 | (1) | 179.7 | 17 | 4.3 | Magnesium sulfate13 | 13 | 0.058 | 78.26 | 21.41 | 0.058 | 36 | 132 | 33 | G1 |
| Ex. 27 | Toner 27 | (1) | 179.7 | 17 | 4.3 | Ferric chloride | 13 | 0.063 | 78.01 | 21.56 | 0.063 | 29 | 136 | 33 | G1 |
| Com. Ex. 1 | Toner 28 | (1) | 179.7 | 17 | 4.3 | Aluminum sulfate | 13 | 0.062 | 77.98 | 21.51 | 0.062 | 172 | 131 | 59 | G5 |
| Com. Ex. 2 | Toner 29 | (1) | 179.7 | 17 | 4.3 | Aluminum sulfate | 13 | 0.059 | 78.24 | 21.36 | 0.059 | 16 | 137 | 31 | G5 |
| Com. Ex. 3 | Toner 30 | (3) | 205.1 | 17 | 4.3 | Aluminum sulfate | 13 | 0.061 | 78.11 | 21.46 | 0.061 | 34 | 132 | 33 | G5 |
| Com. Ex. 4 | Toner 31 | (1) | 179.7 | 17 | 4.3 | Aluminum sulfate | 13 | 0.059 | 78.11 | 21.55 | 0.059 | 5 | 136 | 0 | G5 |
| Com. Ex. 5 | Toner 32 | (3) | 205.1 | 17 | 4.3 | Aluminum sulfate | 13 | 0.061 | 78.11 | 21.46 | 0.061 | 34 | 132 | 0 | G5 |
| Com. Ex. 6 | Toner 33 | Amorphous Resin 1 | 50 | — | — | — | — | 0.058 | 78.36 | 21.22 | 0.058 | 3 | 131 | — | G5 |

As can be seen from Table 1, the toners according to Examples 1 to 27 are superior in image intensity of a halftone image formed on a sheet of paper having a high water content under a high-humidity environment and having coarse fiber, compared with the toners according to Comparative Examples 1 to 6.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner, wherein the toner comprises a toner particle that is prepared by an aggregation process and a coalescence process in an aqueous medium, wherein the aggregation process is performed with an aggregating agent that includes at least one kind of metal element selected from Al, Mg, or Fe, the toner particle comprising:

a binder resin that contains an amorphous polyester resin; and a colorant, wherein the toner satisfies the following expressions, $$20\ \mu S/cm \leq \rho \leq 150\ \mu S/cm \text{ and}$$

$$0.01\% < Cm/(Cc+Co) \times 100 < 0.1\%,$$

where ρ represents a conductivity of a supernatant solution when 0.1 g of the toner is dissolved in 30 ml of tetrahydrofuran, Cm represents a content (% by mass of the total amount of the elements in the toner particle as determined by x-ray fluorescence) of at least one metal selected from Al, Mg, or Fe originating from the aggregating agent, Cc represents a content (% by mass of the total amount of the elements in the toner particle as determined by x-ray fluorescence) of carbon in the toner particle, and Co represents a content (% by mass of the total amount of the elements in the toner particle as measured by x-ray fluorescence) of oxygen in the toner particle.

2. The electrostatic charge image developing toner according to claim 1, wherein the binder resin includes a crystalline resin and an amount of the crystalline resin is in a range of from about 0.1% by mass to about 50% by mass based on a total mass of the binder resin.

3. The electrostatic charge image developing toner according to claim 1, wherein the electrostatic charge image developing toner includes 3-hydroxy-2,2'-iminodisuccinic acid.

4. The electrostatic charge image developing toner according to claim 1, wherein a flow tester half-flow temperature of the toner is in a range of from about 120° C. to about 150° C.

5. An electrostatic charge image developing developer comprising the electrostatic charge image developing toner according to claim 1.

6. The electrostatic charge image developing developer according to claim 5, wherein the binder resin of the electrostatic charge image developing toner includes a crystalline resin and an amount of the crystalline resin is in a range of from about 0.1% by mass to about 50% by mass based on a total mass of the binder resin.

7. The electrostatic charge image developing developer according to claim 5, wherein the electrostatic charge image developing toner includes 3-hydroxy-2,2'-iminodisuccinic acid.

8. A toner cartridge comprising a toner container, wherein the electrostatic charge image developing toner according to claim 1 is contained in the toner container.

9. A process cartridge for an image forming apparatus, comprising:

an image holding member; and a developing unit comprising the electrostatic charge image developing developer according to claim 5, wherein the developing unit develops an electrostatic latent image formed on a surface of the image holding member to form a toner image.

10. The process cartridge for an image forming apparatus according to claim 9, wherein the binder resin of the electrostatic charge image developing toner includes a crystalline resin and an amount of the crystalline resin is in a range of from about 0.1% by mass to about 50% by mass based on a total mass of the binder resin.

11. The process cartridge for an image forming apparatus according to claim 9, wherein the electrostatic charge image developing toner includes 3-hydroxy-2,2'-iminodisuccinic acid.

12. An image forming apparatus comprising:

an image holding member;

a charging unit that charges a surface of the image holding member;

a latent image forming unit that forms an electrostatic latent image on the surface of the image holding member;

a developing unit comprising the electrostatic charge image developing developer according to claim 5, wherein the developing unit develops the electrostatic latent image formed on the surface of the image holding member to form a toner image; and a transfer unit that transfers the developed toner image to a transfer medium.

13. The image forming apparatus according to claim 12, wherein the binder resin of the electrostatic charge image developing toner includes a crystalline resin and an amount of the crystalline resin is in a range of from about 0.1% by mass to about 50% by mass based on a total mass of the binder resin.

14. The image forming apparatus according to claim 12, wherein the electrostatic charge image developing toner includes 3-hydroxy-2,2'-iminodisuccinic acid.

15. An image forming method comprising:

charging the surface of an image holding member;

forming an electrostatic latent image on a surface of the image holding member;

developing the electrostatic latent image formed on the surface of the image holding member with the electrostatic charge image developing developer according to claim 5 to form a toner image; and transferring the developed toner image to a transfer medium.

16. The image forming method according to claim 15, wherein the binder resin of the electrostatic charge image developing toner includes a crystalline resin and an amount of the crystalline resin is in a range of from about 0.1% by mass to about 50% by mass based on a total mass of the binder resin.

17. The image forming method according to claim 15, wherein the electrostatic charge image developing toner includes 3-hydroxy-2,2'-iminodisuccinic acid.

* * * * *